US009254681B2

(12) United States Patent
Sakai

(10) Patent No.: US 9,254,681 B2
(45) Date of Patent: Feb. 9, 2016

(54) TEXTILE-PRINTING APPARATUS

(71) Applicant: SEIKO EPSON CORPORATION, Tokyo (JP)

(72) Inventor: Hiroaki Sakai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/665,714

(22) Filed: Mar. 23, 2015

(65) Prior Publication Data

US 2015/0273866 A1 Oct. 1, 2015

(30) Foreign Application Priority Data

Mar. 25, 2014 (JP) ..... 2014-062576

(51) Int. Cl.
*B41J 2/015* (2006.01)
*B41J 2/01* (2006.01)
*B41J 3/407* (2006.01)

(52) U.S. Cl.
CPC ..... *B41J 3/4078* (2013.01)

(58) Field of Classification Search
CPC ..... B41J 3/4078; B41J 11/002; B41J 2/01; D06P 5/30; D06P 5/003; D06P 5/001
USPC ..... 347/21, 101, 102, 106
See application file for complete search history.

(56) References Cited

FOREIGN PATENT DOCUMENTS

| | | |
|---|---|---|
| JP | 08-311782 | 11/1996 |
| JP | 09-239968 | 9/1997 |
| JP | 2008-075215 | 4/2008 |

*Primary Examiner* — Jannelle M Lebron
(74) *Attorney, Agent, or Firm* — Workman Nydegger

(57) ABSTRACT

A textile-printing apparatus includes a pre-treatment agent-applying section that applies a pre-treatment agent to a textile-printing medium, a press section that compresses, while heating the textile-printing medium, the textile-printing medium to which the pre-treatment agent has been applied, a printing liquid discharge section that discharges a printing liquid to the textile-printing medium that has been compressed while being heated by the press section, and a heater that heats the textile-printing medium to which the printing liquid has been discharged.

3 Claims, 4 Drawing Sheets

TEXTILE-PRINTING APPARATUS

BACKGROUND

1. Technical Field

The present invention relates to a textile-printing apparatus that prints an image on a textile-printing medium.

2. Related Art

There has been known a technique that prints an image on a textile-printing medium by discharging a printing liquid onto a textile-printing medium. According to the related-art, a textile-printing medium is set in a pre-treatment apparatus that applies a pre-treatment agent for fixing a printing liquid to a textile-printing medium. After the pre-treatment agent is applied to the textile-printing medium by the apparatus, the textile-printing medium is set in a textile-printing apparatus. Then, the printing liquid is discharged onto the textile-printing medium by the textile-printing apparatus.

According to such related-art technique, due to the effect of the pre-treatment agent applied to the textile-printing medium, the printing liquid is easily fixed to the textile-printing medium, and print quality is improved. However, since the two apparatuses, that is, the pre-treatment apparatus and the textile-printing apparatus are used, printing operations are time and energy consuming.

On the other hand, a textile-printing apparatus described in JP-A-2008-75215 is equipped with a function to apply a pre-treatment agent to a textile-printing medium. Therefore, a single textile-printing apparatus is capable of applying a pre-treatment agent to a textile-printing medium and discharging a printing liquid to the textile-printing medium.

However, in the textile-printing apparatus described in JP-A-2008-75215, wrinkles and fluff of the textile-printing medium are not particularly taken into account, and therefore, there is a risk that a wrinkle or fluff of a textile-printing medium will degrade print quality.

SUMMARY

An advantage of some aspects of the invention is that the textile-printing apparatus of the invention is less likely to produce degraded printing quality.

This advantage is achieved by the following configurations. A textile-printing apparatus according to an aspect of the invention includes a pre-treatment agent-applying section that applies a pre-treatment agent to a textile-printing medium, a press section that compresses, while heating the textile-printing medium, the textile-printing medium to which the pre-treatment agent has been applied, a printing liquid discharge section that discharges a printing liquid to the textile-printing medium that has been compressed while being heated by the press section, and a heater that heats the textile-printing medium to which the printing liquid has been discharged.

According to the textile-printing apparatus, the various sections perform on the textile-printing medium the following processes. The pre-treatment agent-applying section applies the pre-treatment agent to the textile-printing medium. The press section compresses, while heating the textile-printing medium, the textile-printing medium to which the pre-treatment agent has been applied. By these processes, the shape of the surface of the textile-printing medium is smoothed.

The printing liquid discharge section discharges the printing liquid to the textile-printing medium that has been compressed while being heated by the press section. At this time, since the printing liquid is discharged to the textile-printing medium whose surface shape has been smoothed by compressing the textile-printing medium while heating textile-printing medium, the printing liquid easily reaches a predetermined site on the textile-printing medium at which deposition of the printing liquid is desired.

The heater heats the textile-printing medium to which the printing liquid has been discharged from the printing liquid discharge section. Therefore, the printing liquid is fixed to the pre-treatment agent, so that an image is printed on the textile-printing medium.

Thus, the textile-printing apparatus according to the aspect is capable of performing the processes that are needed in order to print an image on the textile-printing medium, including applying the pre-treatment agent to the textile-printing medium, heating the textile-printing medium to which the pre-treatment agent has been applied, discharging the printing liquid, and heating the textile-printing medium to which the printing liquid has been discharged. Therefore, the time and energy required to print an image on a textile-printing medium are reduced.

In the foregoing textile-printing apparatus, it is preferable that the textile-printing medium be movable relative to the pre-treatment agent-applying section, the press section, the printing liquid discharge section, and the heater in steps corresponding to a predetermined step width, and that movement of the textile-printing medium relative to the pre-treatment agent-applying section, the press section, the printing liquid discharge section, and the heater be temporarily stopped based on the printing liquid discharge section discharging the printing liquid to the textile-printing medium.

According to the textile-printing apparatus, since the printing liquid discharge section discharges the printing liquid to the textile-printing medium during a period in which the movement of the printing liquid discharge section and the textile-printing medium relative to each other is temporarily stopped, an amount of the printing liquid in accordance with an image to be printed is easily deposited. Therefore, print quality degradation is further inhibited.

In the textile-printing apparatus described above, it is preferable that the press section include a roller disposed so as to be rotatable in contact with the textile-printing medium, a built-in heater that is provided in the roller and that heats the roller, and a rotation section that rotates the roller during a period in which the movement of the textile-printing medium relative to at least the pre-treatment agent-applying section, the press section, the printing liquid discharge section, and the heater is temporarily stopped.

According to the textile-printing apparatus, since the roller rotates during the period in which the movement of the textile-printing medium relative to the pre-treatment agent-applying section, the press section, the printing liquid discharge section, and the heater is temporarily stopped, the amounts of time of contact of the roller of the press section with various sites on the textile-printing medium are less likely to vary among the sites.

In the textile-printing apparatus described above, it is preferable that a length of the heater in a direction of the movement of the textile-printing medium and the heater relative to each other be set longer than or equal to the predetermined step width.

The printing liquid discharge section of the textile-printing apparatus discharges the printing liquid to the textile-printing medium at every predetermined step width. Therefore, in the case where the length of the heater is less than the predetermined step width, the heater, when heating the printing liquid on the textile-printing medium, is not able to heat simultaneously the entire amount of the printing liquid in a region on the textile-printing medium which corresponds to the predetermined step width. However, in the case of the heater of the textile-printing apparatus, since the length of the heater is set as described above, it is possible to heat simultaneously the entire amount of the printing liquid in a region on the textile-printing medium which corresponds to the predetermined step width.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
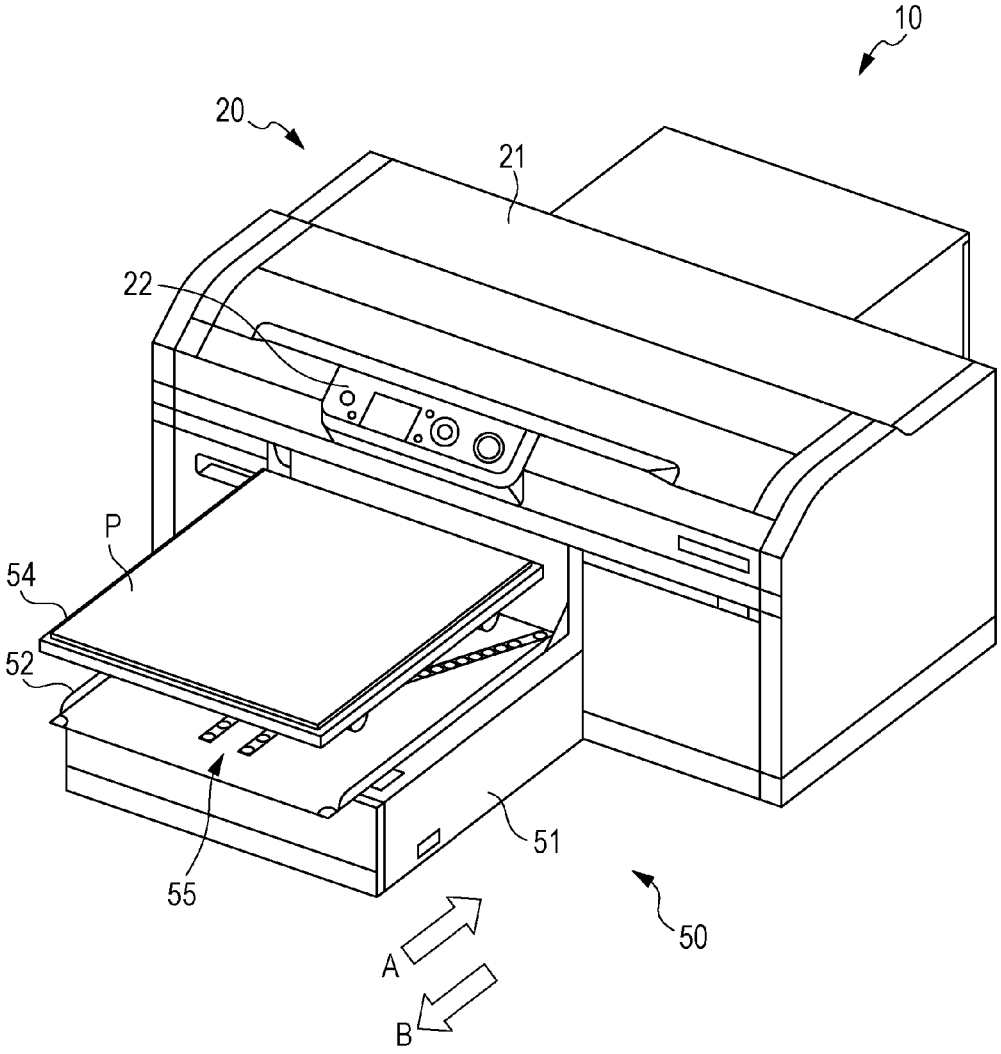
FIG. 1 is a perspective view of a textile-printing apparatus according to an exemplary embodiment of the invention.

A general configuration of a textile-printing apparatus 10 according to the invention will be described with reference to FIG. 1.

The textile-printing apparatus 10 includes a printer apparatus 20 and a transport apparatus 50. The printer apparatus 20 has in an upper portion of a front surface of a casing 21 an operation section 22 that has operating switches, a liquid crystal panel, etc., that are provided to enable operation of the textile-printing apparatus 10.

The transport apparatus 50 includes a transport base 51, a transport guide plate 52, a movement mechanism 53 (see FIG. 2), and a tray 54 as a disposal portion on which a textile-printing medium P is disposed. The transport base 51 extends so as to protrude forward and rearward from the printer apparatus 20. The transport guide plate 52 is disposed on an upper surface of the transport base 51 and includes transport rails 55 that extend in front/rear directions of the printer apparatus 20 that are the directions of the longer sides of the transport base 51.

Figure 2:
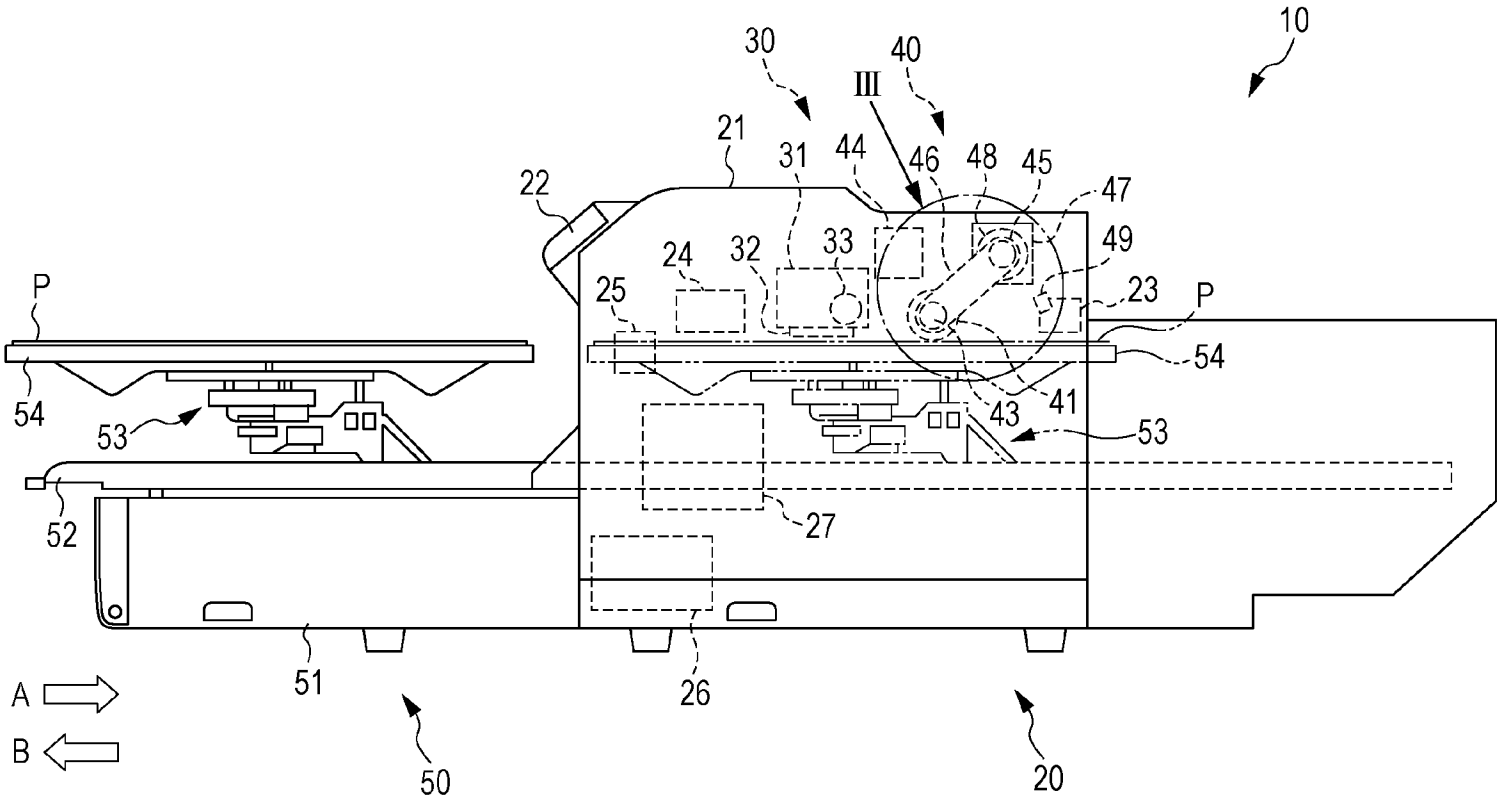
FIG. 2 is a right side view of the textile-printing apparatus of the exemplary embodiment.

With reference to FIG. 2, details of the configuration of textile-printing apparatus 10 will be described.

The printer apparatus 20 has inside the casing 21 a pre-treatment agent-applying section 23, a heater 24, a position sensor 25, a tank 26, a control section 27, a printing liquid discharge section 30, and a press section 40.

The movement mechanism 53 moves the tray 54 mounted above and in line with the transport rails 55 illustrated in FIG. 1 forward and rearward in the front/rear directions of the printer apparatus 20, that is, an inward movement direction indicated by an open arrow A and a return movement direction indicated by an open arrow B. Hereinafter, the inward movement direction and the return movement direction are collectively referred to as "movement direction".

The textile-printing apparatus 10 prints an image on a print surface of a textile-printing medium P by discharging the printing liquid in accordance with the image to be printed when the textile-printing medium P disposed on an upper surface of the tray 54 passes through the printer apparatus 20 as the movement mechanism 53 moves in the movement direction.

The movement mechanism 53 includes an upward/downward drive mechanism (not shown) that changes the position of the tray 54 in the up/down direction. The position sensor 25 detects the position in the up/down direction of the surface of the textile-printing medium P disposed on the tray 54 and outputs a signal that indicates the arrival of the surface of the textile-printing medium P at a predetermined height when the tray 54 is moved in the up/down direction. An example of the position sensor 25 is a displacement sensor equipped with a semiconductor laser and a light reception unit.

The pre-treatment agent-applying section 23 is connected to the tank 26 that stores a pre-treatment agent, via a flow path (not shown). The pre-treatment agent-applying section 23 applies the pre-treatment agent supplied from the tank 26 via the flow path to the textile-printing medium P that is disposed on the tray 54 and moved in the movement direction. Furthermore, the pre-treatment agent-applying section 23 extends in main scanning directions (directions orthogonal to the sheet plane in FIG. 2), to a width that is greater than a width of the tray 54.

The printing liquid discharge section 30 is provided at a return movement direction side of the pre-treatment agent-applying section 23. The printing liquid discharge section 30 includes a carriage 31, a discharge head 32, and a guide shaft 33. The carriage 31 includes a plurality of cartridges (not shown) which store printing liquids of different colors.

The guide shaft 33 is supported so as to extend in the main scanning directions. The printing liquid discharge section 30 discharges the printing liquids from the discharge head 32 to the textile-printing medium P while moving the carriage 31 along the guide shaft 33 in the main scanning directions. Furthermore, when not performing printing, the printing liquid discharge section 30 moves the carriage 31 to a withdrawn position that is away from the tray 54 with respect to the main scanning directions so that the carriage 31 does not contact the textile-printing medium P, which moves in the movement direction.

The heater 24 is provided at the return movement direction side of the printing liquid discharge section 30 and at such a position that the heater 24 does not contact the textile-printing medium P which moves in the movement direction. Furthermore, the heater 24 has a length in the movement direction that is longer than or equal to a predetermined step width (described later) of the textile-printing medium P that moves in the movement direction. The textile-printing medium P is moved in steps corresponding to the step width in the movement direction. The heater 24 generates heat to heat the textile-printing medium P to which the printing liquids have been discharged from the printing liquid discharge section 30.

Next, a configuration of the press section 40 will be described.

Figure 3:
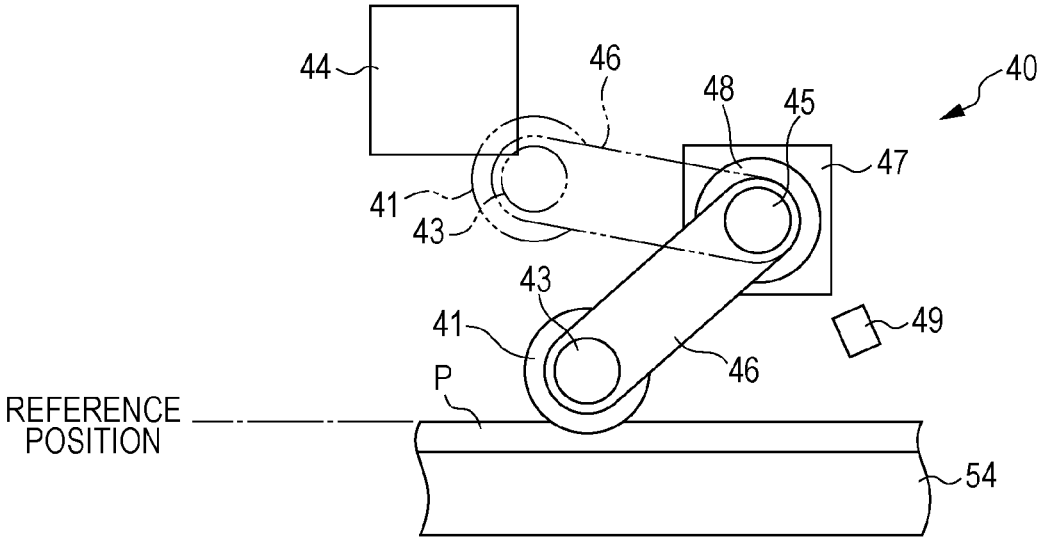
FIG. 3 is an enlarged view of a portion III shown in FIG. 2.

As illustrated in FIG. 3, the press section 40 includes a roller 41, a rotation shaft 43, a rotation section 44, a pivot shaft 45, arms 46, a pivot device 47, a rotary scale 48, and an angle sensor 49. The roller 41 contains a built-in heater 42 that heats the roller 41 (see FIG. 4). The press section 40 is provided at the return movement direction side of the pre-treatment agent-applying section 23.

The roller 41, when in contact with the textile-printing medium P disposed on the tray 54, rotates relative to the rotation shaft 43 as the tray 54 and the textile-printing medium P move in the movement direction. Furthermore, the roller 41 is driven by the rotation section 44 and rotates both when the textile-printing medium P is moving and when the textile-printing medium P is not moving. When the textile-printing medium P is not moving, the rotation section 44 is operated so as to rotate the roller 41 at a driving force such that the roller 41 does not move the textile-printing medium P. Furthermore, when the textile-printing medium P is not moving, the roller 41 is driven by the rotation section 44 so as to rotate and therefore move in the movement direction relative to the textile-printing medium P.

The rotation shaft 43 is supported at two end portions by the pivot shaft 45 via the arms 46 so as to be pivotable relative to the pivot shaft 45. Furthermore, the arms 46 pivot relative to the pivot shaft 45 due to drive force output by the pivot device 47. With this configuration, the press section 40 is capable of moving the roller 41 between a position shown by solid lines in FIG. 3 at which the roller 41 is in contact with the textile-printing medium P and a position shown by two-dot chain lines in FIG. 3 at which the roller 41 is away from the textile-printing medium P.

The rotary scale 48 is attached to one of the right and left arms 46 so as to rotate coaxially with the pivot shaft 45. The rotary scale 48 detects the rotation angle when the arms 46 pivot. The angle sensor 49 outputs a signal that indicates the arrival of the roller 41 at the position at which the roller 41 is in contact with and presses the textile-printing medium P, when the roller 41 pivots toward the textile-printing medium P from the position at which the roller 41 is away from the textile-printing medium P. An example of the angle sensor 49 is a displacement sensor equipped with a semiconductor laser and a light reception portion.

When the operation section 22 is operated by a user, the control section 27 outputs control signals that control operations of the pre-treatment agent-applying section 23, the press section 40, the printing liquid discharge section 30, the heater 24, and the transport apparatus 50 on the basis of the content of the operation performed by the user.

Figure 4:
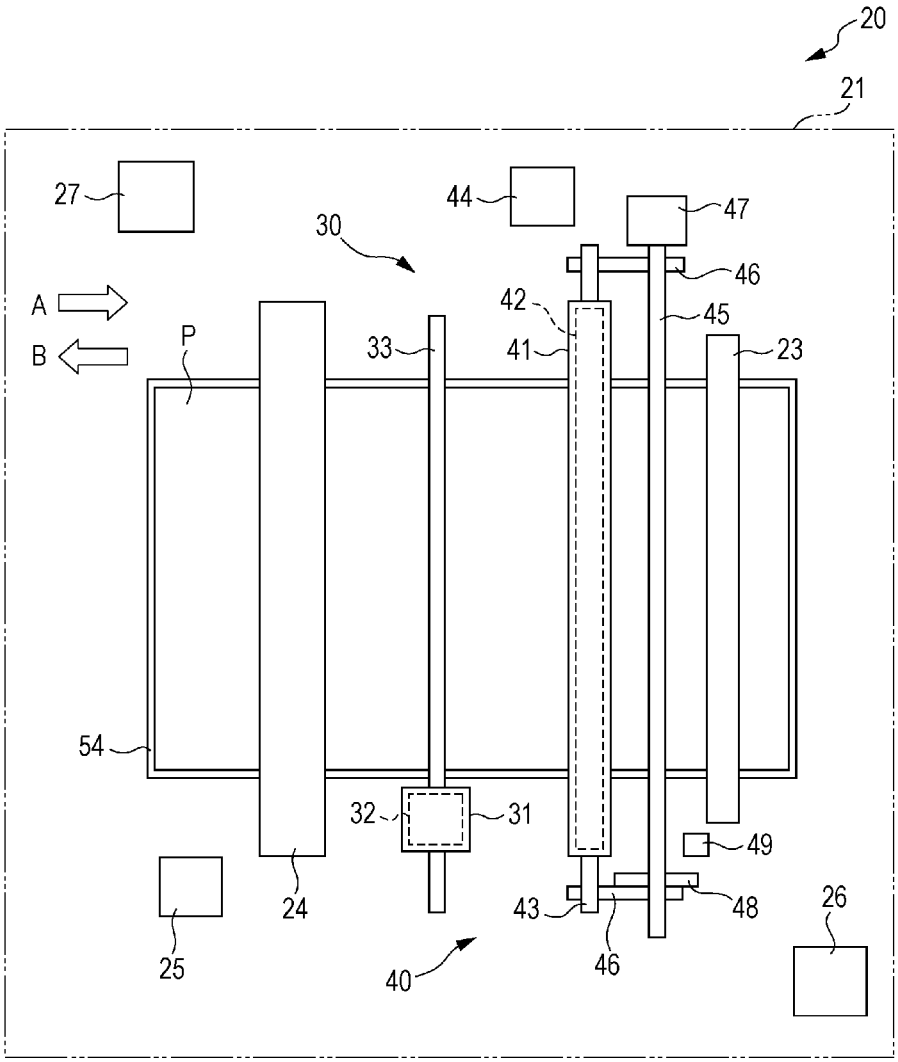
FIG. 4 is a plan view of the textile-printing apparatus of the exemplary embodiment.

With reference to FIG. 4, operation of the textile-printing apparatus 10 will be described.

FIG. 4 illustrates a state in which the tray 54 on which the textile-printing medium P is disposed has been moved into the printer apparatus 20. In FIG. 4, the transport base 51, the transport guide plate 52, the movement mechanism 53, the transport rails 55, and the tank 26 are not illustrated.

When not performing printing, the textile-printing apparatus 10 has the tray 54 moved to a lower position that is lower than a position of the tray 54 during printing and that is in front of the printer apparatus 20. Furthermore, during the not-printing state, the textile-printing apparatus 10 has the roller 41 moved to the position shown by the two-dot chain lines in FIG. 3 at which the roller 41 is away from the textile-printing medium P. Hereinafter, the state in which the tray 54 has moved to the lower position and the roller 41 has moved to the position at which the roller 41 is away from the textile-printing medium P will be referred to as the "initial state".

After the textile-printing medium P is disposed on the tray 54 held at the lower position and the operation section 22 is operated to give a print command, the movement mechanism 53 moves the textile-printing medium P into the printer apparatus 20 on the basis of the control signal from the control section 27. Next, the control section 27 lifts the tray 54 from the initial state. The control section 27 lifts the tray 54 until the position sensor 25 detects that a surface of the textile-printing medium P facing the up/down direction has reached a reference position indicated in FIG. 3. Therefore, the control section 27 sets the surface of the textile-printing medium P disposed on the tray 54 to the reference position, without being affected by the thickness of the textile-printing medium P disposed on the tray 54. The control section 27 stores as a print-time position the position of the tray 54 in the up/down direction at which the surface of the textile-printing medium P exists at the reference position.

Next, when the tray 54 moves in the inward movement direction to the location of the roller 41, the press section 40 pivots the roller 41 toward the textile-printing medium P on the basis of the control signal from the control section 27. The control section 27 pivots the roller 41 until the angle sensor 49 detects that the roller 41 has reached the position at which the roller 41 presses the textile-printing medium P. Therefore, the control section 27 sets the position of the roller 41 to the position at which the roller 41 presses the textile-printing medium P disposed on the tray 54, without being affected by the thickness of the textile-printing medium P disposed on the tray 54.

The rotary scale 48 detects the rotation angle of the arms 46 occurring when the position of the roller 41 is the position at which the roller 41 presses the textile-printing medium P. The control section 27 stores as a print-time angle the rotation angle of the arms 46 detected by the rotary scale 48.

After storing the print-time position of the tray 54 and the print-time angle of the arms 46, the control section 27 sets the tray 54 and the roller 41 to the initial state and then moves the tray 54 to a movement end site in the inward movement direction.

Next, the control section 27 sets the position of the tray 54 in the up/down direction to the stored print-time position and the rotation angle of the arms 46 to the stored print-time angle and then starts printing on the textile-printing medium P by moving the tray 54 in the return movement direction from the movement end site in the inward movement direction in steps corresponding to the predetermined step width, that is, in a manner in which movement of the tray 54 by the predetermined distance and a temporary stop are alternately performed.

When the textile-printing medium P has moved to the location of the pre-treatment agent-applying section 23, the pre-treatment agent-applying section 23 applies the pre-treatment agent to the textile-printing medium P on the basis of the control signal from the control section 27. The pre-treatment agent-applying section 23 applies the pre-treatment agent to the textile-printing medium P entirely in the main scanning direction.

Next, when the textile-printing medium P has moved to the location of the press section 40, the roller 41, whose position in the up/down direction has been set to the position at which the roller 41 presses the textile-printing medium P, rotates on the textile-printing medium P as the textile-printing medium P moves in steps corresponding to the predetermined step width, presses and heats the textile-printing medium P to which the pre-treatment agent has been applied. Furthermore, the roller 41 rotates due to a drive force output by the rotation section 44, both during periods in which the textile-printing medium P is moved by the predetermined step width and during periods in which the textile-printing medium is at a temporary stop. Therefore, the print surface of the textile-printing medium P is pressed so that the shape of the surface is flattened. Furthermore, the pre-treatment agent applied to the textile-printing medium P dries due to heat from the roller 41.

After that, when the textile-printing medium P has moved to the location of the printing liquid discharge section 30, the printing liquid discharge section 30 discharges printing liquids in accordance with the image to be printed, to the flattened print surface of the textile-printing medium P on the basis of the control signal from the control section 27. During the temporary stop periods between the step-width movements of the tray 54, the printing liquid discharge section 30 discharges the printing liquids from the discharge head 32 while moving the carriage 31 in the scanning direction along the guide shaft 33.

When the textile-printing medium P to which the printing liquids have been discharged moves to the location of the heater 24, the printing liquids are fixed to the textile-printing medium P due to heat produced by the heater 24. Since the length of the heater 24 in the movement direction is set to a size that is greater than or equal to the predetermined step width, the heater 24 heats simultaneously the entire content of the printing liquids in a region that corresponds to the predetermined step width on the textile-printing medium P to which the printing liquid discharge section 30 discharges the print liquids. Furthermore, the heater 24 produces heat from a location at which the heater 24 is not in contact with the textile-printing medium P and thus the heater 24 does not scrape the printing liquids on the textile-printing medium P.

After the textile-printing medium P is heated by the heater 24, the control section 27 further moves the textile-printing medium P in the return movement direction to discharge the textile-printing medium P carrying a printed image to the front of the printer apparatus 20.

According to the exemplary embodiment described above, the following effects are obtained.

(1) According to the textile-printing apparatus 10, as the tray 54 is moved, the textile-printing medium P passes by the pre-treatment agent-applying section 23, the press section 40, the printing liquid discharge section 30, and the heater 24 in this order. Therefore, the textile-printing apparatus 10 is able to apply the pre-treatment agent to the textile-printing medium P, heat and smooth the surface of the textile-printing medium P, discharge the printing liquids, and heat the printing liquids on the textile-printing medium P. Therefore, the textile-printing apparatus 10 is capable of performing the processes that are needed in order to print an image on a textile-printing medium, that is, from the application of the pre-treatment agent to the heating of the printing liquids. Therefore, the time and energy required to print an image on a textile-printing medium P are reduced. Furthermore, if a textile-printing medium P has wrinkles, the wrinkles are removed, and if fluff is formed on a textile-printing medium P, the fluff is flattened. Furthermore, since the textile-printing medium P receives heat from the press section 40, the pre-treatment agent applied to the textile-printing medium P by the pre-treatment agent-applying section 23 is easily fixed to the textile-printing medium P. Therefore, since the printing liquid discharge section 30 discharges the printing liquids to the textile-printing medium P whose surface has been smoothed by compression and heating, degraded print quality due to wrinkles or the like of the textile-printing medium P is inhibited.

(2) The textile-printing medium P disposed on the tray 54 is moved relative to the pre-treatment agent-applying section 23, the press section 40, the printing liquid discharge section 30, and the heater 24 in steps corresponding to the predetermined step width. The printing liquid discharge section 30 discharges the printing liquids to the textile-printing medium P during the periods in which the movement of the textile-printing medium P in steps corresponding to the predetermined step width is at a temporary stop. Therefore, amounts of the printing liquids in accordance with an image to be printed are easily deposited. Therefore, degraded print quality is further inhibited.

(3) The rotation section 44 rotates the roller 41 both during the periods in which the textile-printing medium P is being moved in steps corresponding to the predetermined step width and during the periods in which the textile-printing medium P is at a temporary stop. Therefore, the quantity of heat applied to the pre-treatment agent on the textile-printing medium P as the roller 41 is in contact with the textile-printing medium P and moves relative to the textile-printing medium P is less likely to vary from one site to another on the textile-printing medium P. Hence, the degree of fixation of the pre-treatment agent achieved when the textile-printing medium P passes through the press section 40 becomes uniform over the entire textile-printing medium P. Therefore, since the degree of fixation of the printing liquids discharged from the printing liquid discharge section 30 to the pre-treatment agent on the textile-printing medium P becomes uniform over various sites on the textile-printing medium P, print quality further improves.

(4) The length of the heater 24 in the movement direction is set greater than or equal to the predetermined step width of the textile-printing medium P. Therefore, the heater 24 is able to heat simultaneously the entire content of the printing liquids in a region that corresponds to the predetermined step width of the textile-printing medium P, to which the printing liquids have been discharged by the printing liquid discharge section 30.

Therefore, the exemplary embodiment may be changed to other exemplary embodiments as described below.

In the foregoing exemplary embodiment, the textile-printing apparatus 10 may have a configuration in which the pre-treatment agent-applying section 23, the press section 40, the printing liquid discharge section 30, and the heater 24 are moved in the movement direction relative to the textile-printing medium P disposed on the tray 54. Since the textile-printing apparatus 10, as in the foregoing exemplary embodiment, is capable of performing the processes that are needed in order to print an image on a textile-printing medium P, including the processes from the application of the pre-treatment agent to the textile-printing medium P to the heating of the printing liquids. Therefore, the time and energy required to print an image on a textile-printing medium P are reduced.

In the foregoing exemplary embodiment, the textile-printing apparatus 10 may have a configuration in which both the textile-printing medium P disposed on the tray 54 and the pre-treatment agent-applying section 23, the press section 40, the printing liquid discharge section 30, and the heater 24 are moved in the movement directions. Since the textile-printing apparatus 10, as in the foregoing exemplary embodiment, is capable of performing the processes that are needed in order to print an image on a textile-printing medium P, including the processes from the application of the pre-treatment agent to the textile-printing medium P to the heating of the printing liquids. Therefore, the time and energy required to print an image on a textile-printing medium P are reduced.

In the foregoing exemplary embodiment, the rotation section 44 may be configured to stop outputting a drive force for rotating the roller 41 during the periods in which the textile-printing medium P disposed on the tray 54 is being moved relative to the pre-treatment agent-applying section 23, the press section 40, the printing liquid discharge section 30, and the heater 24.

In the foregoing exemplary embodiment, the textile-printing apparatus 10 may be configured to move the textile-printing medium P disposed on the tray 54 in the inward movement direction, perform the processes needed in order to print an image on a textile-printing medium, including the process of setting the print-time position of the tray 54 and the print-time angle of the arms 46 and the processes from the application of the pre-treatment agent to the textile-printing medium P to the heating of the printing liquids.

In the foregoing exemplary embodiment, the printing liquid discharge section 30 may have a configuration that includes a line head-type printing liquid discharge section in which a plurality of discharge nozzles are arranged in the main scanning direction. With this configuration, the textile-printing apparatus 10 is able to perform printing at high speeds.

In the foregoing exemplary embodiment, the pre-treatment agent-applying section 23 may have a configuration that includes a pre-treatment agent discharge portion and a second guide shaft extending in the main scanning direction and that causes the pre-treatment agent discharge portion to discharge the pre-treatment agent while moving the pre-treatment agent discharge portion in the main scanning directions along the second guide shaft.

In the foregoing exemplary embodiment, the textile-printing apparatus 10 may have a configuration in which the printing liquids discharged from the printing liquid discharge section 30 to the textile-printing medium P are heated by using the press section 40. In the textile-printing apparatus 10, the textile-printing medium P to which the printing liquids have been discharged is moved in the inward movement direction, and when the textile-printing medium P reaches the location of the press section 40, the printing liquids on the textile-printing medium P are heated by heat produced by the built-in heater 42 of the roller 41.

In the foregoing exemplary embodiment, the pre-treatment agent-applying section 23 may discharge the pre-treatment agent to a region that includes a region to which the printing liquid discharge section 30 discharges the printing liquids.

The entire disclosure of Japanese Patent Application No. 2014-062576, filed Mar. 25, 2014 is expressly incorporated by reference herein.

What is claimed is:

1. A textile-printing apparatus comprising:

a pre-treatment agent-applying section that applies a pre-treatment agent to a textile-printing medium;

a press section that compresses, while heating the textile-printing medium, the textile-printing medium to which the pre-treatment agent has been applied;

a printing liquid discharge section that discharges a printing liquid to the textile-printing medium that has been compressed while being heated by the press section; and a heater that heats the textile-printing medium to which the printing liquid has been discharged, wherein the textile-printing medium is movable relative to the pre-treatment agent-applying section, the press section, the printing liquid discharge section, and the heater in steps corresponding to a predetermined step width; and wherein movement of the textile-printing medium relative to the pre-treatment agent-applying section, the press section, the printing liquid discharge section, and the heater is temporarily stopped based on the printing liquid discharge section discharging the printing liquid to the textile-printing medium.

2. The textile-printing apparatus according to claim 1, wherein the press section includes:

a roller disposed so as to be rotatable in contact with the textile-printing medium;

a built-in heater that is provided in the roller and that heats the roller; and a rotation section that rotates the roller during a period in which the movement of the textile-printing medium relative to at least the pre-treatment agent-applying section, the press section, the printing liquid discharge section, and the heater is temporarily stopped.

3. The textile-printing apparatus according to claim 1, wherein a length of the heater in a direction of the movement of the textile-printing medium and the heater relative to each other is set longer than or equal to the predetermined step width.

* * * * *